US005470061A

United States Patent [19]

Colburn et al.

[11] Patent Number: 5,470,061

[45] Date of Patent: Nov. 28, 1995

[54] RACQUETBALL RACQUET HAVING INCREASED STIFFNESS AT TIP

[75] Inventors: Todd B. Colburn, San Diego; John F. Lorentzen, El Cajon, both of Calif.

[73] Assignee: Ektelon, San Diego, Calif.

[21] Appl. No.: 267,448

[22] Filed: Jun. 28, 1994

[51] Int. Cl.[6] ..... A63B 49/02

[52] U.S. Cl. ..... 273/73 C; 273/73 R; 273/73 G

[58] Field of Search ..... 273/73 R, 73 C, 273/73 D, 73 G

[56] References Cited

U.S. PATENT DOCUMENTS

| | | | |
|---|---|---|---|
| D. 260,415 | 8/1981 | Erwin et al. . | |
| 3,999,746 | 12/1976 | Head . | |
| 4,265,450 | 5/1981 | Drake et al. . | |
| 4,280,699 | 7/1981 | Drake . | |
| 4;531,738 | 7/1985 | Mortvedt et al. . | |
| 5,076,583 | 12/1991 | Hsu | 273/73 C |
| 5,183,265 | 2/1993 | Umlauft et al. | 273/73 C |
| 5,342,045 | 8/1994 | Feeney | 273/73 D |

OTHER PUBLICATIONS

Total Racquetball™:Racquetball in the RTS™ Era (56 pages: published by Ektelon, San Diego, CA; undated), pp. 1–26 and 56.

*Primary Examiner*—Raleigh W. Chiu

*Attorney, Agent, or Firm*—Oldham & Oldham Co.

[57] ABSTRACT

Racquetball racquet having a frame forming a head and a handle characterized by a side profile comprising two intersecting arcs having different radii of curvature and intersecting at a point of intersection which is in the region of but above the throat of the racquet. These two arcs define two oppositely tapered frame segments. The first frame segment extends from the tip of the racquet, where the frame height is at a maximum, to the point of intersection, where the frame height is at a minimum. The second frame segment extends from the handle, at or below the throat, to the point of intersection. The arc defining the first segment is of much larger radius of curvature than the arc defining the second segment. This affords a maximum frame cross-sectional area at the tip and a smaller frame cross-sectional area in a flex zone which includes the point of intersection. The resulting racquet has a greater stiffness moment at the tip and a smaller stiffness in the flex zone which may afford more power and greater control.

5 Claims, 2 Drawing Sheets

RACQUETBALL RACQUET HAVING INCREASED STIFFNESS AT TIP

TECHNICAL FIELD

This invention relates to racquets and especially to racquetball racquets. More particularly, this invention relates to a racquetball racquet having a variable frame cross sectional area which imparts increased stiffness to the racquet tip and at the same time greater flexibility in a zone close to the throat.

BACKGROUND ART

Rapid strides have been made in racquetball racquet technology in recent years. Wood frames have given way to frames made of high-technology, high modulus material, such as graphite fibers, aramid fibers, fiberglass, and composites and combinations of these materials. Only a decade ago, the maximum length of racquetball racquets sanctioned by the American Amateur Racquetball Association (AARA) was 18½ inches. Most racquets today are from 19 to 21 inches long and are classified as either mid-size (19–20 inches) or over-size (20–21 inches). The weight of most racquetball racquets is from 210 to 250 grams. Various head shapes, more notably the quadriform and the tear-drop shape, and modifications thereof, are in use. Various throat constructions are also known. Racquets are available in varying degrees of stiffness, to meet the needs of players ranging in ability from a recreational player to a professional player.

Although racquetball racquets have been improved greatly in recent years, there is still room for improvement which would result in greater power, better control, and better durability.

SUMMARY OF THE INVENTION

This invention provides a racquet comprising a frame having a head portion connected to a handle portion. This racquet has a handle end, a throat and a tip which are aligned along a longitudinal axis of the racquet. The head portion of the frame, as seen in side profile, has a frame height which is at a maximum at the tip, decreases in height gradually from the maximum at the tip to a minimum at a point of minimum frame height which is between the throat and a mid-section of the head portion, and then gradually increases in height from that point of .minimum frame height to a point toward the handle end of the racquet. The side profile is formed by first and second arcs which intersect at the point of minimum frame height. The first arc has a first radius of curvature and extends from the tip to the point of minimum frame height; the second arc has a second radius of curvature and extends from the point of minimum frame height to a second point toward the handle end of the racquet at or below the throat. The first radius of curvature is about 20 to about 50 times the length of the racquet, the second radius of curvature is from about one to about three times the length of the racquet, and the first radius of curvature is from about 10 to about 20 times the second radius of curvature.

In a preferred embodiment, the racquet is a racquetball racquet.

DESCRIPTION OF THE PREFERRED EMBODIMENT

Figure 1:
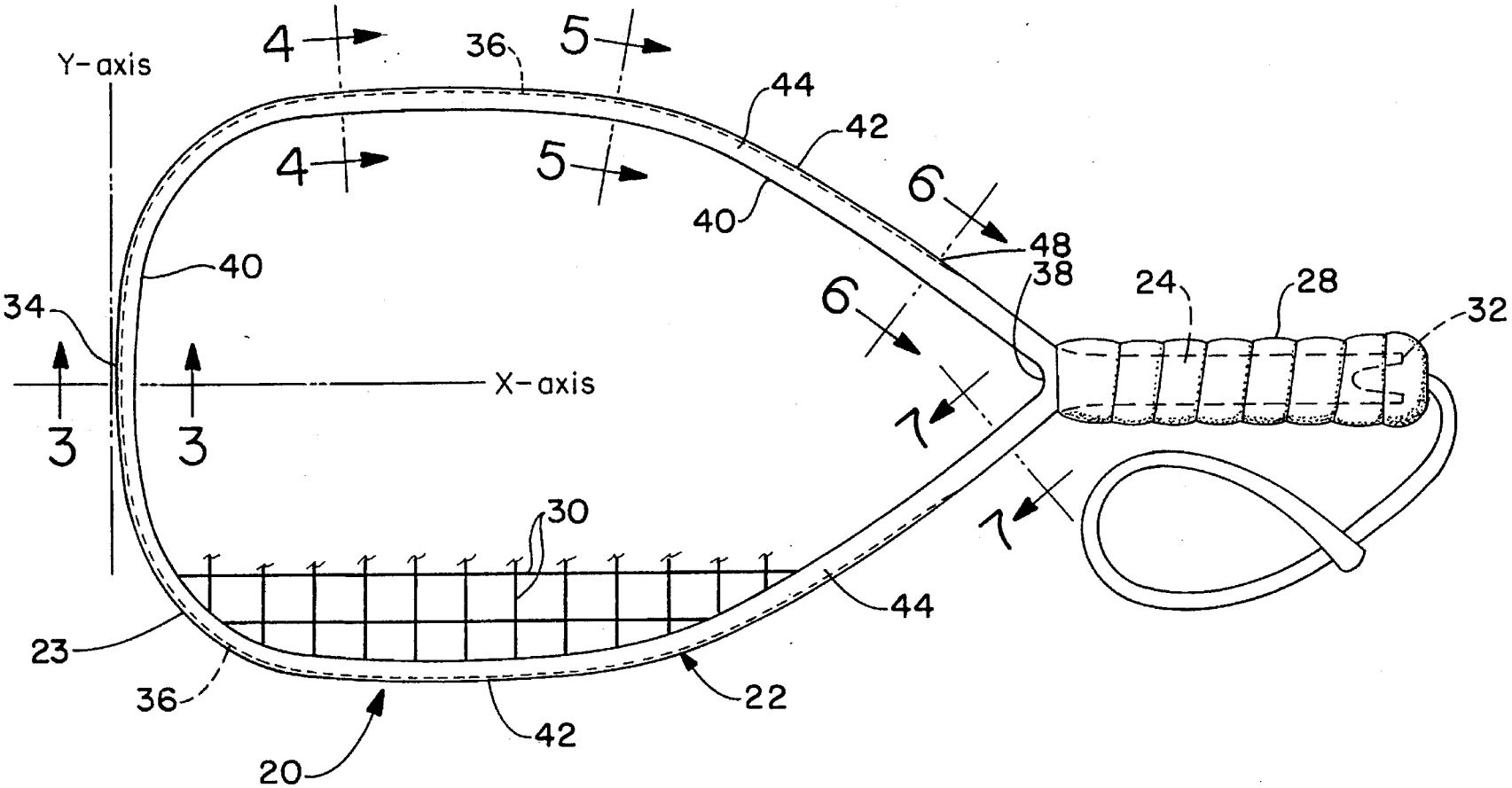
FIG. 1 is a plan view of a racquet according to this invention.

This invention will now be described in detail with respect to a preferred embodiment of the invention. The preferred racquet is a racquetball racquet. A racquetball racquet preferably has an overall length of 19 to 24 inches, more preferably 20 to 22 inches, and a weight of 180 to 250 grams, preferably 210 to 250 grams.

Referring especially to Figs. I and 2, 20 is a racquetball racquet according to a preferred embodiment of this invention. Racquet 20 is symmetrical with respect to a longitudinal (or X) axis. Racquet 20 comprises frame 22, which is shaped in the form of a head 23 of generally elliptical shape and a longitudinally extending handle (or handle shaft) 24. Head 23 is a closed curve having a major axis which is aligned with the longitudinal axis of handle 24 and the racquet 20 as a whole, and a minor axis which is transverse to the major axis. The major axis is longer than the minor axis of the head. Two end segments of frame 22 in side-by-side relationship form the handle 24, and a middle portion of the frame forms the head 23.

A handle grip 28, which may be conventional, may be wrapped around the handle 24. A first or middle portion of the frame 22, herein the head portion, forms head 23, and a second portion of the frame 22, herein the handle, comprising two straight and longitudinally extending end segments which may be in side-by-side relationship, forms the handle 24.

Frame 22 is formed of a high-strength, high modulus material or composite laminate. Frame materials may include graphite (which is available in fibers of different grades having different moduli), aramid and fiberglass. The frame may have a core, which may be either solid or hollow. The core may be an elastomeric material, fiberglass, or aramid, for example. Laminates of these materials (and other frame materials if desired) may be used. Materials and composite laminate constructions are chosen in accordance with the stiffness desired, as is known in the art. In general, the greater the player's ability, the stiffer the racquet he or she prefers.

Head shapes and throat configurations known in the art may be used. Preferred head shapes are a quadriform shape and a teardrop shape. Head 23 shown in FIG. 1 has a quadriform shape.

Racquet 20 has a plurality of strings 30 which extend between spaced points on the head 23. Strings 30 include a longitudinally extending first set and a transversely extending second set. The strings lie in a common plane, forming a planar strung surface. Conventional string materials and stringing patterns may be used.

Racquet 20 has a butt end (or handle end) 32, a throat 38, and a tip (or tip end) 34 at spaced points along a longitudinal (or X) axis. Handle 24 extends longitudinally from the butt or handle end 32 to throat 38. Head 23 extends from throat 38 to tip 34. Head 23 and handle 24 are connected to each other at throat 38.

Racquet 20 has three mutually orthogonal axes, i.e., the longitudinal or X axis, a transverse or Y axis, and a third or Z axis. The X axis is the longitudinal center line of the racquet 20 as a whole and of head 23. The Y axis herein is taken as passing through tip 34 at right angles to the X axis. The X and Y axes lie in the plane of strings 30. The Z axis, which is perpendicular to the plane of strings 30, also passes through tip 34.

Figure 5:
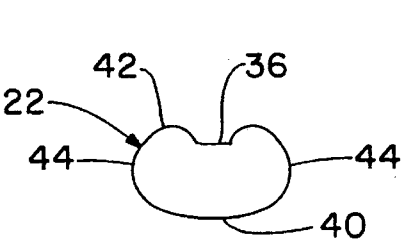
FIG. 5 is a cross-sectional view of the frame of the racquet of FIG. 1, taken along line 5—5 of FIG. 1.
Figure 7:
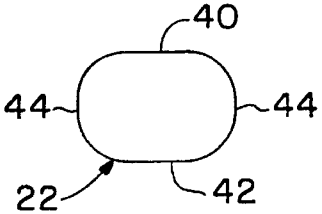
FIG. 7 is a cross-sectional view of the frame of the racquet of FIG. 1, taken along line 7—7 of FIG. 1.
Figure 4:
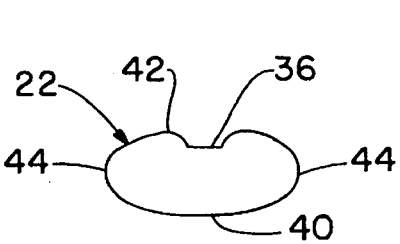
FIG. 4 is a cross-sectional view of the frame of the racquet of FIG. 1, taken along line 4—4 of FIG. 1.
Figure 3:
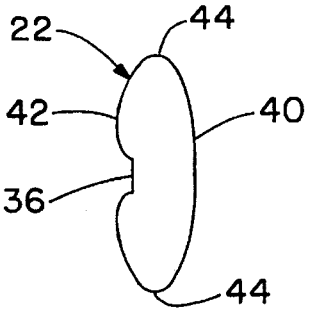
FIG. 3 is a cross-sectional view of the frame of the racquet of FIG. 1, taken along line 3—3 of FIG. 1.

A representative cross-sectional shape of frame 22 in the head portion thereof ranges continuously from essentially oval at the tip 34, as shown in FIG. 3, to essentially rectangular with rounded corners at the throat 38, as shown in FIG. 7. The frame may be regarded as having an inner peripheral surface 40, an outer peripheral surface 42 (which are opposite each other), and opposite lateral surfaces 44. An inwardly extending channel 36 may be formed in the outer peripheral surface 42 of the frame 22, and extends over most of the perimeter of head 23, i.e., over the entire perimeter of the head except a small portion near throat 38, as shown in FIG. 7. Boundaries between adjacent surfaces (e.g., inner peripheral surface 40 and the lateral surfaces 44 on either side thereof) are indistinct in the preferred embodiment shown, since corners are rounded. In fact, the lateral surfaces 44 are rounded in the tip portion (FIGS. 3 and 4) and the mid-section (FIG. 5) of head 23. Other frame cross-sectional shapes may be used provided the side profile and mass distribution are as discussed hereinafter.

Figure 2:
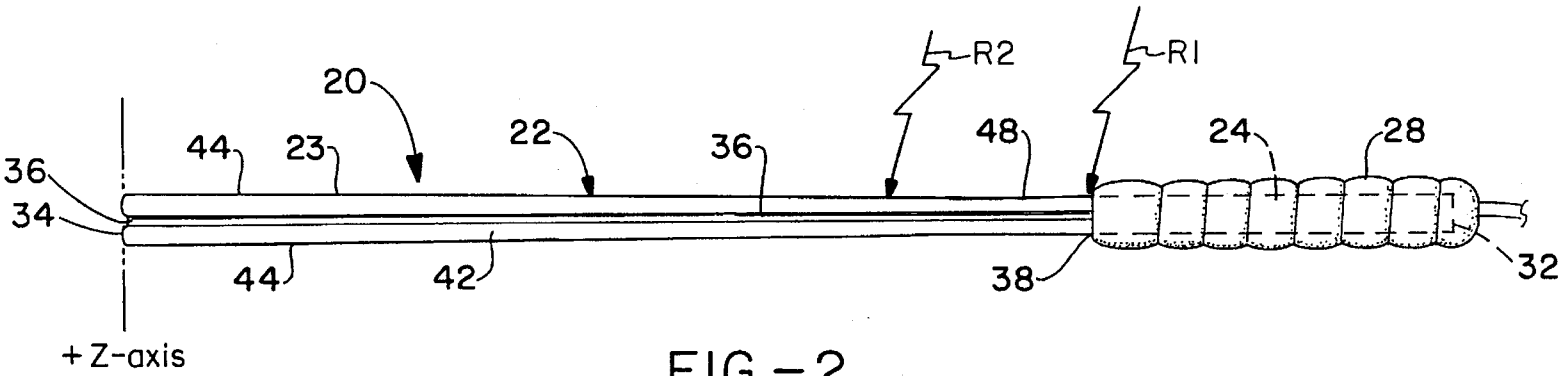
FIG. 2 is a side view of the racquet shown in FIG. 1.
Figure 6:
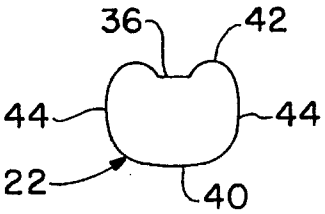
FIG. 6 is a cross-sectional view of the frame of the racquet of FIG. 1, taken along line 6—6 of FIG. 1.

FIG. 2 shows a side profile of a racquet 20 according to this invention. The side profile is formed by the lateral surfaces 44 of the head portion of frame 22 as seen in side view. The side profile shows how frame 22 varies in height over its length from tip 34 to throat 38. Each lateral surface 44 comprises a pair of oppositely tapered arcuate segments, which intersect at flex point 48, which is the point at which the height of frame 22 (which is measured from one lateral surface 44 to the opposite lateral surface 44) is at a minimum. Flex point 48 is located near but above the throat 38, and is the point at which the cross-sectional view shown in FIG. 6 is taken. The intersection at flex point 48 is typically non-tangential.

The side profile in FIG. 2 shows a racquet as it would appear when resting on a horizontal table. The term "frame height" herein refers to the vertical dimension of the frame 22 (i.e., parallel to the Z axis) when viewed in side profile, as in FIG. 2.

The highest point on the head portion of frame 22 (the portion of frame 22 which forms head 23) is at the tip 34 of the racquet. The frame becomes slowly but progressively less high along the length of the frame until a minimum height is reached at a point of intersection 48 (the "flex point") in the throat region of the racquet head 23 but spaced from the throat 38 itself. The frame then becomes higher from flex point 48 to throat 38, (or to a point in the handle 24 which is below throat 38 and above handle end 32).

Both segments of the side profile 44 are arcuate. The first arcuate segment, extending from tip 34 to flex point 48 has a very large radius of curvature, generally about 20 to about 50 times the overall length of racquet 20 and typically about 700 inches. The second segment, tapering from throat 38 (or a point between handle end 32 and throat 38) to point 48 has a much smaller radius of curvature, e.g., about 1 to about 3 times the length of the racquet 20 and typically about twice the length of the racquet, i.e., about 40 to 42 inches. The radius of curvature of the first segment is typically about 10 to about 20 times the radius of curvature of the second segment.

The first arcuate segment, a "power arc", defines an aesthetically-pleasing profile while increasing the frame cross-sectional area at the tip, providing increased stiffness moment at the tip which may enlarge the sweet zone and may increase power. The second arcuate segment, a "flex arc", provides a zone of increased flexure in the mid-section and at the flex point 48 of the racquet head 23, i.e., at the locations shown in FIGS. 5 and 6.

The cross-sectional width of the head portion of frame 22 (which is measured from the inner peripheral surface 40 to the outer peripheral surface 42) varies from a minimum at the tip 34 (see FIG. 3) to a maximum in the throat region (see FIGS. 6 and 7). Variations in cross-sectional width may be observed in FIGS. 3–7.

The cross-sectional area of the head portion of frame 22 is at a minimum in a region extending from the mid-section of the racquet head 23 (FIG. 5) to the vicinity of flex point 48 (the point of minimum frame height) and increases on either side of this region, going toward either the tip 34 or the throat 38. The cross-sectional area of the head portion of frame 22 may be greatest either at the tip 34 (which is the case in the racquet shown in the drawings), or at the throat 38, or the cross-sectional areas at the tip and the throat may be equal. The cross-sectional shapes of the frame 22 at the tip 34 and the throat 38 are quite different, however. This variation in cross-sectional area over the head portion of the frame results in a mass distribution which affords greater stiffness at the tip, a flex zone in a region which includes the mid-section and the flex point 48 of the head 23 (shown in FIGS. 5 and 6, respectively), and other advantages which will be discussed thereafter. The high, narrow shape at the tip is to be contrasted with the less high, but wider, cross-sectional shape at the throat. The high, narrow shape at the tip provides the aerodynamic advantages of a narrow frame as well as a large mass at the tip, which imparts increased stiffness and a large sweet spot as previously noted.

A racquet according to the present invention has increased stiffness at the tip and decreased stiffness (i.e., greater flexure) in the mid-section and the lower portion (or throat region) of the racquet head above the throat, as compared to presently known racquetball racquets. The present racquet also may have an enlarged sweet zone and is able to produce more power than conventional racquets. Greater stiffness at the tip and greater flexure in the mid-section and near but above the throat give the player better control. Racquets of the present invention also have a greater pull-in moment in the mid-section and the lower portion of the racquet head than presently known racquets. This give greater impact strength and better durability. (The terms, "upper", "lower", "above", and "below" as used herein refer to a racquet in play and held so that the tip is above the player's hand. The terms "upper" and "above" express "toward the tip" and "lower" and "below" express "toward the handle end".)

The size and shape of handle 24 may be in accordance with racquetball racquet design principles which are known in the art. The handle 24, for example, may be of uniform cross-sectional area over its entire length (or over a lower portion of the handle length in those instances in which the second segment described earlier begin in the handle at a point below throat 38).

This invention will now be described further with respect to a specific racquet which is made in accordance with this invention. The specific racquet has a quadriform head shape and a throat configuration as shown in FIG. 1.

Dimensions of the racquet are as follows: broad, 19–24 inches; preferred, 20–22 inches.

The side profile of the racquet frame 22 in the portion forming head 23 is defined by two arcs which may have respective radii $R_1$=700 inches and $R_2$=40 inches. These arcs intersect non-tangently at point 48, which is the point at which FIG. 6 is taken. This point is at a distance of 90% of the total distance from tip 34 to throat 38. The first arc ($R_1$=700 inches) extends from the racquet tip 34 to point 48. The second arc ($R_2$=40.7 inches) extends from the throat 38 to point 48. The X co-ordinates of the respective centers of these arcs may be as follows:

First arc ($R_1$=700 inches): X=17 inches

Second arc ($R_2$=40 inches): X=13 inches

The cross-sectional height of the frame 22 in inches (measured from one lateral surface 44 to the opposite lateral surface 44) at various points in the head, is shown in Table 1 below.

TABLE 1

| HEIGHT OF RACQUET FRAME (INCHES) | | | |
|---|---|---|---|
| | BROAD | PREFERRED | SPECIFIC |
| At tip 34 | 0.8–1.3 | 0.8–1.0 | 0.9 |
| At flex point 48 | 0.4–0.9 | 0.4–0.6 | 0.5 |
| At throat 38 | 0.5–1.0 | 0.5–0.7 | 0.6 |

The maximum stiffness moment S and torsional moment T are at the tip 34. The minimum stiffness moment S and minimum torsional moment T are at flex point 48. (Stiffness :moment S is a measure of beam bending.) Both stiffness moment S and torsional moment T may be measured in inches. The maximum stiffness moment of the frame should be at least about 3 times the minimum stiffness moment.

For comparison, stiffness properties of the above racquet and corresponding cross sectional dimensions and a commercial racquetball racquet will be compared and contrasted. The commercial racquet used for comparison purposes is an Ektelon RTS racquetball racquet. There is no change in frame width of the comparison from the mid-section of the head to the throat. The head portion of the racquet frame has a side profile which is defined by two intersecting segments, namely, a straight tapered segment (approximately 0.75°) extending from the tip to the mid-section, in which frame height decreases uniformly with length, and a straight segment extending from the mid-section to the throat, in which there is no change in frame height. The comparison racquet has no flex point (corresponding to point 48 herein), and frame dimensions (both height and width) are the same at locations corresponding to FIGS. 5 and 6 herein.

The racquet of this invention has a higher stiffness moment (about 15–18% higher) than the Ektelon RTS comparison racquet at the tip, but a lower stiffness moment in the mid-section of the head and in the lower portion of the head near but displaced from the throat (FIG. 6). This is achieved by the unique side profile of the racquet of this invention, which side profile is characterized by a double arcuate taper from the tip and from the throat to a point of intersection of the two arcs, at which point the frame height of the head portion of the invention racquet is at a minimum. Table 2 below gives a comparison of the respective mechanical properties of the invention racquet and the comparison racquet at the five cross-sectional locations shown in FIGS. 3–7. This comparison is given as the percentage difference between a value for the racquet of this invention and the corresponding value in the comparison racquet. A positive (+) sign indicates a higher value in the invention racquet; a negative (–) sign indicates a lower value in the invention racquet.

TABLE 2

| PERCENTAGE DIFFERENCE BETWEEN INVENTION RACQUET AND COMPARISON RACQUET | | | | | |
|---|---|---|---|---|---|
| Figure | 3 | 4 | 5 | 6 | 7 |
| S | +18% | +10% | –11% | –29% | –6% |
| P | +2% | +8% | +6% | +49% | +22% |
| T | +17% | +9% | –8% | –13% | –2% |

In addition to greater stiffness (S and T) at and near the tip (FIGS. 3 and 4) and less stiffness in a "flex zone" from the mid-section to the lower portion near but not at the tip (FIGS. 5 and 6), the racquet of this invention exhibits a much greater pull-in moment P (also measured in inches) at and near the throat (FIGS. 6 and 7), which is indicative of greater side impact strength in this region.

While this invention has been described in detail with particular reference to a preferred embodiment thereof, it shall be understood that such description is by way of illustration and not limitation. Variations and modifications can be made by those skilled in the art, and this invention shall be limited only by the scope by the appended claims.

What is claimed is:

1. A racquetball racquet comprising a frame having a head portion connected to a handle portion, said head portion forming a head and said handle portion forming a handle, said racquet having a handle end, a throat, and a tip;

the frame having a side profile which is formed by oppositely tapered first and second arcs having first and second radii of curvature and intersecting at a point of intersection which is between said throat and a mid-section of said head;

said frame having a maximum frame height at said tip and a minimum frame height at said point of intersection;

said first arc having a first radius of curvature and extending from the tip to the point of minimum frame height, the second arc having a second radius of curvature and extending from the point of minimum frame height to a second point at or below the throat;

said first radius of curvature being about 20 to about 50 times the length of the racquet, said second radius of curvature being from about one to about three times the length of the racquet, and said first radius of curvature being from about 10 to about 20 times the second radius of curvature.

2. A racquet according to claim 1 wherein said second arc extends from the throat of the racquet to said point of minimum frame height.

3. A racquet according to claim 1 wherein said racquet is a racquetball racquet having a length from about 19 to 21 inches and a weight from about 210 to about 250 grams.

4. A racquet according to claim 1 wherein the maximum stiffness of the head portion of the frame is at the tip and the minimum stiffness of the head portion of the frame is in a zone which includes the point of minimum frame height.

5. A racquet according to claim 4 wherein said maximum stiffness moment of the frame is at least about 3 times said minimum stiffness moment.

* * * * *